US006109851A

United States Patent [19]

Bauer et al.

[11] Patent Number: 6,109,851

[45] Date of Patent: Aug. 29, 2000

[54] SCREWS HAVING SELECTED HEAT TREATMENT AND HARDENING

[75] Inventors: Mark D. Bauer, Mount Prospect; William A. Spring, Geneva; Michael Starozhitsky, Buffalo Grove; S. Riaz U L Hasan, Palatine, all of Ill.

[73] Assignee: Illinois Tool Works Inc., Glenview, Ill.

[21] Appl. No.: 09/229,435

[22] Filed: Jan. 13, 1999

[51] Int. Cl.[7] ..... F16B 23/00; F16B 25/00; F16B 35/06

[52] U.S. Cl. ..... 411/411; 411/403; 411/387.7; 411/424

[58] Field of Search ..... 411/402, 403, 411/404, 410, 411, 424, 900, 901, 387.1, 387.6, 387.7, 387.8

[56] References Cited

U.S. PATENT DOCUMENTS

| | | | |
|---|---|---|---|
| 2,086,801 | 7/1937 | Hayden | 148/10 |
| 2,224,659 | 12/1940 | Stoll . | |
| 2,229,565 | 1/1941 | Hallowell, Jr. . | |
| 3,090,712 | 5/1963 | Berry | 148/146 |
| 3,301,120 | 1/1967 | Lloyd . | |
| 3,344,817 | 10/1967 | Connard | 148/12.1 |
| 3,376,780 | 4/1968 | Tanczyn . | |
| 3,765,660 | 10/1973 | Taylor et al. | 266/6 R |
| 3,769,103 | 10/1973 | Wardwell et al. | 148/147 |
| 3,983,304 | 9/1976 | Sekhon | 428/460 |
| 4,021,274 | 5/1977 | Chadwick | 148/146 |
| 4,289,006 | 9/1981 | Hallengren | 72/38 |
| 4,295,351 | 10/1981 | Bjorklund et al. | 72/38 |
| 4,385,081 | 5/1983 | Keller et al. | 427/80 |
| 4,486,248 | 12/1984 | Ackert et al. | 148/145 |
| 4,583,898 | 4/1986 | Sygnator | 411/387 |
| 4,670,310 | 6/1987 | Tengqvist | 427/388.4 |
| 4,690,837 | 9/1987 | Doroszkowski et al. | 427/314 |
| 4,702,880 | 10/1987 | Porowski et al. | 376/305 |
| 4,730,970 | 3/1988 | Hyner et al. | 411/387 |
| 4,835,819 | 6/1989 | Duffy et al. | 427/195 |
| 4,842,655 | 6/1989 | Porowski et al. | 148/130 |
| 4,842,890 | 6/1989 | Sessa et al. | 427/47 |
| 4,877,463 | 10/1989 | Aicher et al. | 148/12 B |
| 5,033,181 | 7/1991 | Lat et al. | 29/433 |
| 5,120,175 | 6/1992 | Arbegast et al. | 411/501 |
| 5,178,903 | 1/1993 | Lai et al. | 427/446 |
| 5,283,280 | 2/1994 | Whyte et al. | 524/559 |
| 5,302,068 | 4/1994 | Janusz et al. | 411/402 |
| 5,403,624 | 4/1995 | Dimaio et al. | 427/421 |
| 5,417,776 | 5/1995 | Yoshino et al. | 148/318 |
| 5,484,244 | 1/1996 | Glovan et al. | 411/424 |
| 5,498,659 | 3/1996 | Esser | 524/549 |
| 5,536,582 | 7/1996 | Prasad et al. | 428/450 |
| 5,564,876 | 10/1996 | Lat | 411/439 |
| 5,605,423 | 2/1997 | Janusz | 411/387 |
| 5,605,722 | 2/1997 | Esser | 427/388.4 |
| 5,605,952 | 2/1997 | Esser | 524/522 |
| 5,605,953 | 2/1997 | Esser | 524/522 |
| 5,609,965 | 3/1997 | Esser | 428/522 |
| 5,614,262 | 3/1997 | Joesten | 427/318 |
| 5,616,367 | 4/1997 | Spearin et al. | 427/532 |
| 5,618,372 | 4/1997 | Erdrich et al. | 156/310 |
| 5,655,969 | 8/1997 | Lat | 470/5 |
| 5,755,542 | 5/1998 | Janusz et al. | 411/387 |

OTHER PUBLICATIONS

Marketing brochure of Elco Industries, Inc., entitled "DRIL– FLEX, A New Concept In Structural Fastening", dated Feb. 1989.

*Primary Examiner*—Neill Wilson
*Attorney, Agent, or Firm*—Pauley Peterson Kinne & Fejer

[57] ABSTRACT

A carbon steel screw has one or more portions which have been selectively hardened by selective heat treatment and quenching. In one embodiment, an upper portion of the screw head is selectively hardened to prevent or reduce damage when torque is applied using a driving tool. In another embodiment, the screw tip is selectively hardened for more effective penetration into a substrate. Preferably, the selectively heated portions are selectively quenched to reduce or avoid distortion.

25 Claims, 9 Drawing Sheets

SCREWS HAVING SELECTED HEAT TREATMENT AND HARDENING

FIELD OF THE INVENTION

This invention relates to carbon steel screws and similar fasteners having selectively hardened portions to create desired properties and behavior, and a method for making the selectively hardened screws.

BACKGROUND OF THE INVENTION

Stainless steel screws having selectively hardened regions are known from U.S. Pat. No. 3,376,780, issued to Tanczyn. Tanczyn discloses a stainless steel screw having selectively hardened screw flight crests and a selectively hardened head region for insertion of a screwdriver. These regions are harder than the remaining portions of the screw. The stainless steel screw has a carbon content not exceeding 0.20% by weight, a chromium content of 10–25% by weight, a nickel content of 5–20% by weight, a copper content of 1–5% by weight, and an aluminum content of 0.25–2.5% by weight. The hardening is accomplished by cold-working the stainless steel at about 700–900° F., and by age-hardening at about 1050–1250° F. The hardening is the greatest in the regions of the greatest cold-working.

U.S. Pat. No. 4,295,351, issued to Bjorklund et al., discloses a stainless steel screw whose flight crests have been selectively hardened. The selective hardening is achieved by aggressive cold-working of the precursor fastener blanks, at sub-zero temperatures, during formation of the threads. Another selectively hardened stainless steel screw is disclosed in U.S. Pat. No. 4,289,006 issued to Hallengren.

U.S. Pat. No. 2,229,565, issued to Hallowell Jr., discloses a socket screw whose head portion is selectively hardened. The bead portion of the screw is rapidly heated by induction to an elevated temperature. The entire screw is then quenched, causing hardening of the heated portion. The resulting screw may have a Rockwell "C" hardness ("$R_C$") of about 48–50 in the head region, and a lower $R_C$ of about 30–35 in the remaining portions.

U.S. Pat. No. 5,755,542, issued to Janusz et al., discloses a screw having selectively hardened threads at a lower end of the screw shank, and a selectively hardened tip. U.S. Pat. No. 5,605,423, issued to Janusz, discloses a stud having selectively hardened threads at a lower end of the stud, and a selectively hardened tip.

Certain standard carbon steel screws (having a single slot in the head) and cross-recessed screws (having two slots in the head which cross each other) can only be exposed to a limited driving torque from a driving tool (e.g. screwdriver). When the head slots are exposed to excessive turning force, the slots become enlarged and damaged, so that the driving tool can no longer effectively engage the slots.

Consideration has been given to hardening the head portion of screws to strengthen the slots. However, the hardening can cause the head and upper shank portion to become excessively brittle, resulting in 1) the head breaking from the screw shaft when excessive turning force is applied, 2) hydrogen embrittlement if the screws are plated, and 3) head-popping caused by thermal expansion and contraction of the substrate(s) to which the screw is applied, which creates stress that cannot be relieved by screw elongation. Also, selective heating of the head portion to cause hardening can result in distortion of the screw when the entire screw (having a varying temperature profile) is exposed to a quenching fluid.

SUMMARY OF THE INVENTION

The present invention is directed to a selectively hardened carbon steel screw having a differential hardness profile within the head portion. A screw is provided having a head portion, a shank portion below the head, and a lower end portion or tip. The head portion has a top surface, a bottom surface, a center, an outer rim, and at least one slot in the center for engaging a driving tool. The invention also encompasses a carbon steel screw having a selectively hardened tip which facilitates initial penetration of the screw into a substrate.

In accordance with the invention, the head portion is selectively hardened in the center and at the top so that the center of the head portion near the top is harder than the bottom of the head portion and the adjacent screw shank. Put another way, the ridges and walls defining the slot are selectively hardened at the top to provide strength and hardness and reduce damage caused by a driving tool. Yet the bottom of the head portion and the adjacent shank remain relatively soft and pliable, so that the head portion does not break away from the shank when high torque or high stress, such as shear stress, is applied.

The invention also includes a method for selectively hardening the head portion at the center and near the top. A source of heat, which can be a flame jet, is applied directly to the top and center of the head portion, causing that region to reach a temperature above 1400° F. The maximum temperature reached at the top and center of the head portion is higher than the temperature reached at the bottom of the head portion or adjacent portion of the screw shaft. Then, the screw can be differentially quenched to reduce or prevent distortion. Differential quenching can be accomplished by aiming a quenching fluid directly at the top center of the head portion, to achieve maximum quenching at the hottest region. The quench fluid can then be allowed to flow from the head portion to the remaining portions of the screw, where less quenching is wanted.

The invention includes a similar technique for selectively heat treating and quenching the tip of a screw, to cause localized hardening.

DETAILED DESCRIPTION OF THE PRESENTLY PREFERRED EMBODIMENTS

Figure 1:
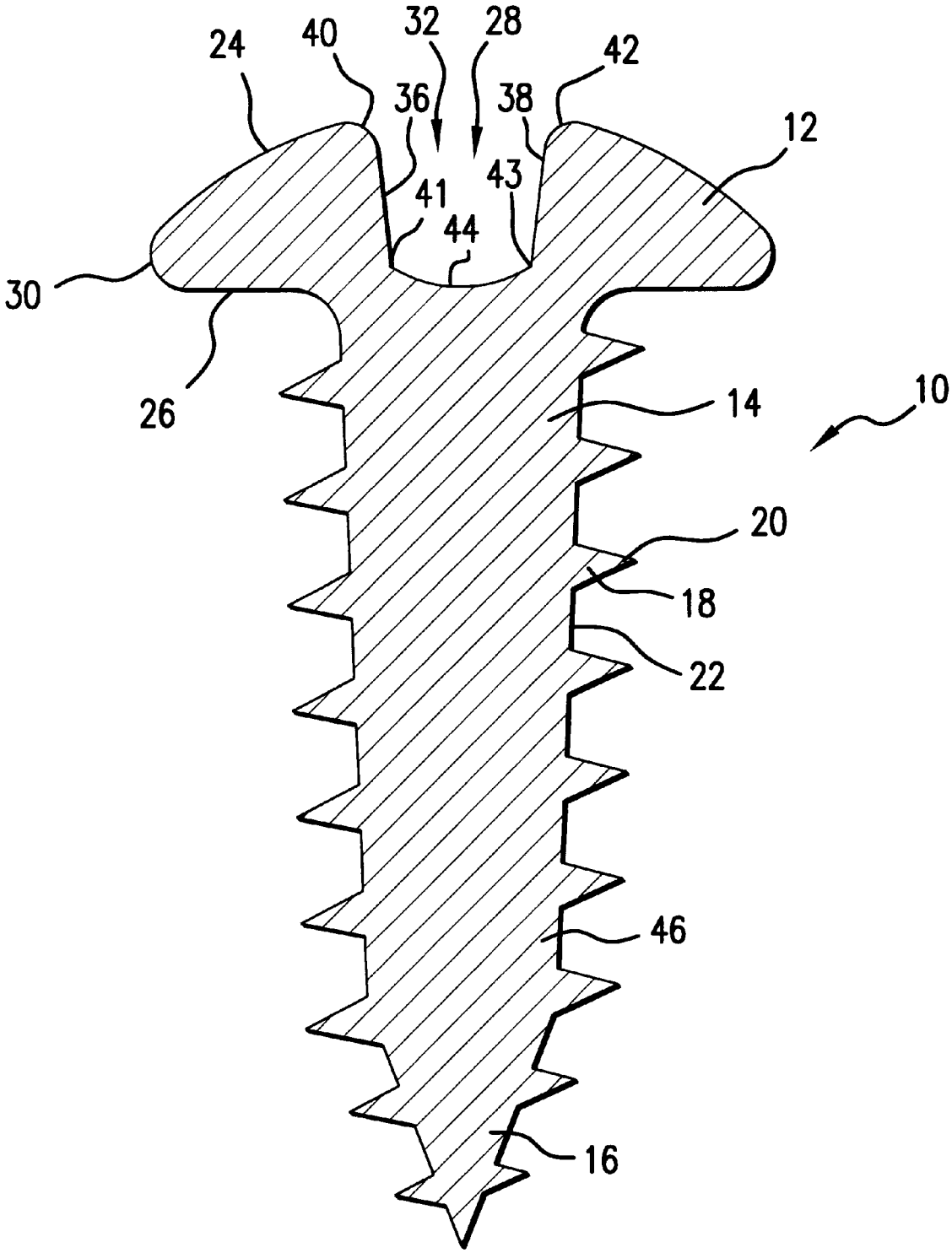
FIG. 1 is sectional view of a screw of the invention having selected hardening in the head region.

Referring to FIG. 1, a carbon steel screw 10 of the invention has a head portion 12, a shank 14 below the head, and a screw tip 16 at an end of the shank opposite the head. A plurality of screw flights or threads 18 having peaks 20 and valleys 22 between them, wind around the outer rim of the shank 14 and tip 16.

Figure 2:
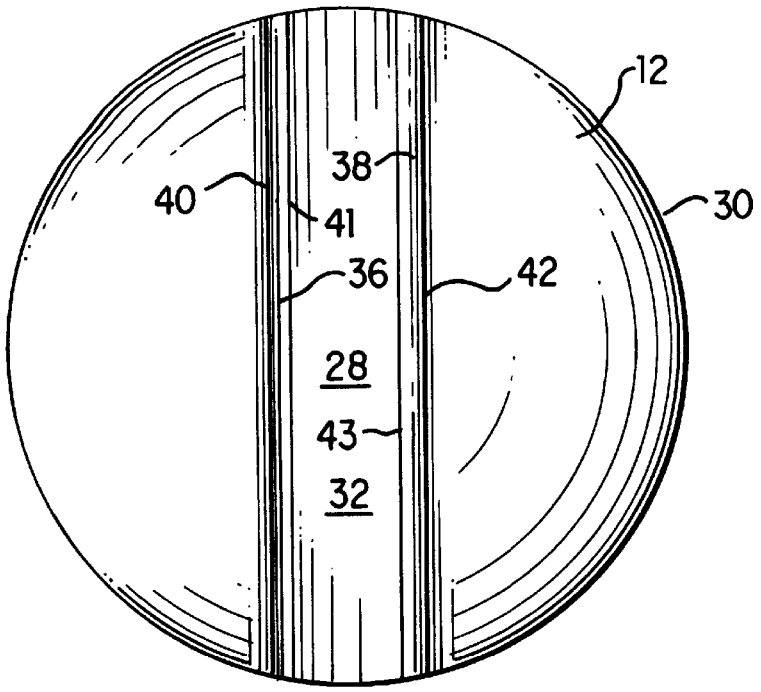
FIG. 2 is a top view of the screw of FIG. 1.
Figure 3:
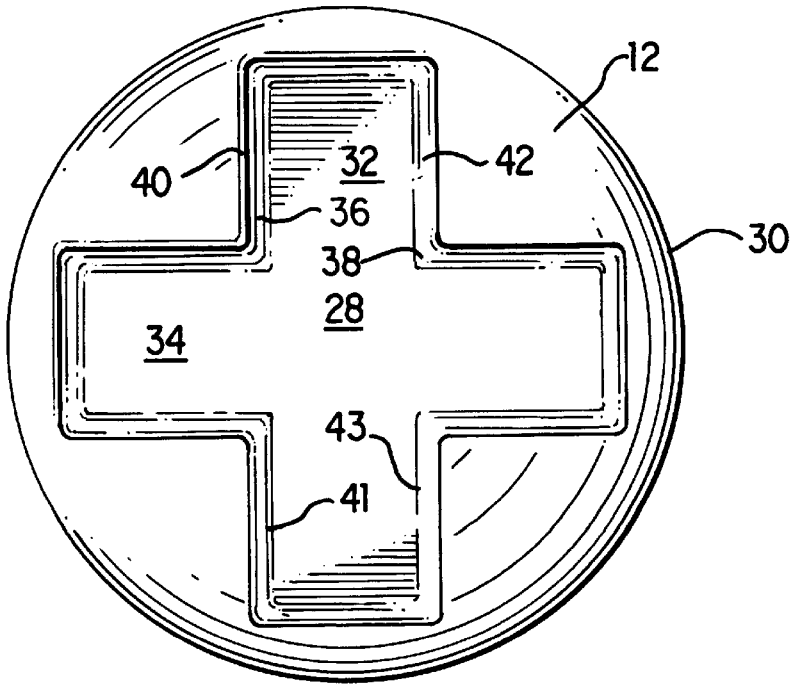
FIG. 3 is a top view of another embodiment of the screw of the invention.

Referring to FIGS. 1—3, the head portion 12 has a top surface 24, a bottom 26, a center region 28, and an outer rim 30. The center region 28 includes either a single slot 32 for receiving a standard screwdriver or similar tool, or a pair of intersecting slots 32 and 34 for receiving a Phillips™ screwdriver or similar tool designed for cross-recessed screws.

Each slot is defined by a pair of opposing, generally upright walls 36 and 38 which intersect the top surface 24 at ridges 40 and 42, and which also intersect the slot floor 44 at junctions 41 and 43. The slot depth is the distance between ridges 40 and 42 and slot floor 44. The slot floor 44 may actually be located below the screw head 12 and in the adjacent shank 14, indicating a slot depth greater than the thickness of the screw head as shown in FIG. 1. Alternatively, the slot floor 44 may be about even with the bottom 26 of head 12, or may be above the bottom 26 of head 12, in which case the slot 32 (or slots 32 and 34) are located entirely within the head portion 12.

The screws 10 of the invention are selectively hardened to create a differential hardness profile within the head portion 12. A flame jet or other source of heat is applied directly to the upper surface 24 in the vicinity of center region 28, so that the heating is greatest at the highest points near the center, namely the ridges 40 and 42 of the slot 32 (or slots 32 and 34). The ridges 40 and 42 are heated to a temperature of at least about 1400° F., preferably about 1500–2000° F., more preferably about 1600–1800° F. The heating causes the affected portions (on and around ridges 40 and 42) to transform from a ferritic perlitic metallurgical structure to an austenitic metallurgical structure. The heating is sufficiently directed, and for a short enough period of time, that the bottom 26 of head 12 and adjacent portion of shaft 14 do not experience this transformation.

The screws 10 are then quenched by directing a quenching fluid to the portion of head 12 which experienced the greatest heating. The quenching fluid may be water or another liquid or gas, and may be poured, sprayed, sprayed with air assist, or otherwise applied directly to the upper surface 24 in the vicinity of the center region 28. The applied quenching fluid may then flow down over the head, so as to have a lesser quenching impact on portions of the screw which experienced less heating. The selective quenching causes the hottest portions (on and around ridges 40 and 42) to transform from the austenitic metallurgical structure to a martensitic structure, which is hardened but untempered. The bottom portion 26 of screw head 12, and the adjacent portion of shank 14, remain substantially in the ferritic perlitic state, which is softer and more pliable. By selectively quenching the hottest portion of the head 12 to a greater extent than the cooler portions, distortion of the screw due to quenching is minimized.

The quenching fluid may have a temperature of about 40–200° F., preferably about 50–150° F., more preferably about 60–100° F. Tap water or other process water is suitable. Other quenching media may include oil or gas. The quench time need not be more than about 30 seconds, and may be about 3–10 seconds. The screw head may still be warm after quenching in order to facilitate drying.

The resulting selectively hardened carbon steel screw has a hardness differential of at least about 10 Rockwell "C" ("$R_C$") units within the head portion itself. The ridges 40 and 42 near the center of the head 12 should have an $R_C$ of at least about 45, preferably at least about 50, more preferably at least about 55. The bottom 26 of the head 12, and the upper region of shank 14, should have an $R_C$ no greater than about 35.

The remaining portions of screw head 12 may have an $R_C$ value closer to the $R_C$ of the ridges 40 and 42, or closer to the $R_C$ of the bottom 26, depending on their proximity to either location. For instance, the walls 36 and 38 of slot 32 (or slots 32 and 34) should have an $R_C$ of at least about 45 near the top and near the center, yet may have an $R_C$ of about 35 or lower near the junctions 41 and 43 of the slot floor 44. The slot floor 44 may have an $R_C$ of about 35 or less. The upper surface 24 may have an $R_C$ of at least about 45 close to the ridges and close to the center, and may or may not have a lower $R_C$ closer to the rim 30.

By selectively hardening the screw head 12 in this fashion, the slot 32 is provided with additional strength and hardness which reduces deformation and damage when a screwdriver or similar tool is applied at high torque. By allowing the bottom 26, head 12 and adjacent shank 14 to remain softer, the possibility of the head breaking away due to high torque or high shear stress is reduced. The invention is particularly useful for roofing screws, and other screws which have long shafts and/or which are driven into resistant substrates, because these screws are routinely subjected to high shear stress levels due to extreme temperature variations experienced on a roof.

The screw 10 should be constructed from a fairly low carbon steel. Suitable carbon contents may range from about 0.08–0.50% by weight of the steel, with a preferred rang of about 0.18–0.35% by weight of the steel. The carbon should be sufficient to facilitate hardening of the steel by heat treatment, yet not high enough to facilitate work hardening during cold heading, pointing, or thread rolling of the screw. Put another way, the screw 10 of the invention is selectively heat hardened, and preferably, not work hardened.

Figure 4:
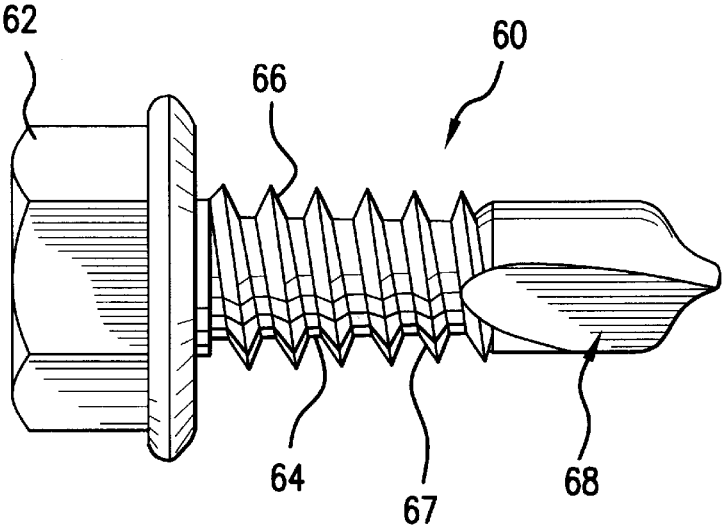
FIG. 4 illustrates a drill point screw which can be selectively hardened according to the invention.

In another embodiment illustrated in FIG. 4, the selectively hardened screw of the invention may be a drill tip screw. One type of drill tip screw 60 includes a hexagonal head portion 62, a threaded shaft 64 including one or more spiral threads 66, and a drill point 68 which can be used to tap and drill at least a portion of the screw 60 into a substrate. The head portion 62 may be selectively hardened on its exterior faces using techniques described above for improved strength and integrity. Furthermore, the tip 68, and a portion 67 of shank 64 encompassing the first few threads 66 above the tip 68, may be selectively heat treated and hardened in order to facilitate initial penetration of the screw 60 into a substrate, and initial thread tapping. A roofing screw may be hardened at the tip and just above the tip, in order to overcome the need to drill a hole in the substrate to get the screw started.

Referring to FIG. 4, the end portion 67 of screw 60, defined as the lower region of shank 64 adjacent the tip, may be selectively hardened along with the tip 68 by initially applying a flame jet or other heat source directly to the end region 67 and tip 68. End region 67 and tip 68 are heated to at least about 1400° F., preferably about 1500–2000° F., more preferably about 1600–1800° F. The selective heating causes end region 67 and tip 68 to change from a ferritic perlitic metallurgical structure to an austenitic metallurgical structure. Then, end region 67 and tip 68 are selectively quenched by dipping or directing a quenching fluid directly at them. The selective quenching (which causes even cooling around the screw, but differential quenching along its length) converts the austenitic metallurgical structure to a martensitic metallurgical structure in the heated region, which is untempered but hard. The quenching fluid may be water, and may be applied at the temperatures and quench times stated above for the head portion.

The end regions 67 and tips 68 of screws 60 should be hardened to an $R_C$ value of at least about 45, preferably at least about 50, more preferably at least about 55. The untreated region of shank 64 above end region 67 may have an $R_C$ at least about 10 units lower than the hardened end region, and may have an $R_C$ of about 35 or less, perhaps 25 or less.

The hardened region 67 of the shank may then be tempered to yield a hardness value $R_C$ of between about 35–45, which is higher than the starting $R_C$ value yet lower than the selectively hardened value. Tempering can be accomplished by reheating the selectively hardened region 67 to about 600–1100° F., preferably about 750–1000° F. Preferably, the tip 68 is not tempered, but is instead maintained at its maximum hardness. The spiral threads 66 may also be case hardened (i.e. hardened on their exterior) to reduce damage when the screw is driven into a substrate. This is particularly useful in the case of long drill screws used for roofing.

Figure 5:
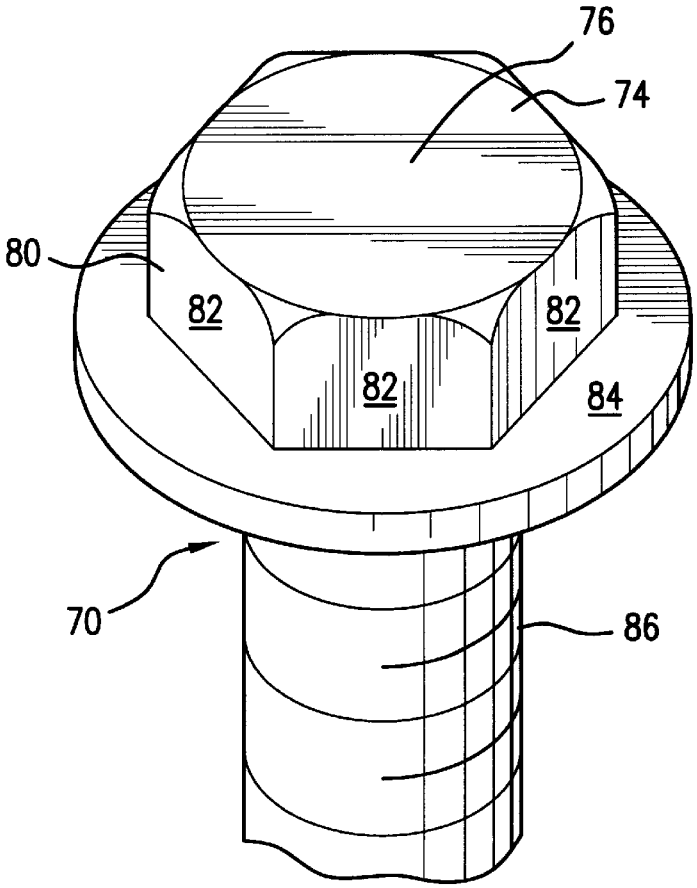
FIG. 5 illustrates a hex-head screw which can be selectively hardened according to the invention.

In another embodiment, the selectively hardened screw may be a hex-head screw having a hexagonal head portion for receiving a driving tool. Referring to FIG. 5, the screw 70 has a head 74, with a top surface 76. The head 74 also has a hexagonal outer surface 80 composed of six rectangular flat surfaces 82. In the embodiment shown, a permanent washer 84 is positioned between the head 74 and the elongated threaded shank 86 of the screw.

In accordance with the invention, selected portions of hex-head screw 70 may be hardened using the techniques described above. The top of head portion 72, which receives the driving tool, may be selectively hardened to provide better resistance to damage and wear. By hardening the six outer faces 82 of the head portion, the performance of the screw and driving tool can be enhanced due to improved interaction using a socket driving tool.

Again, the drill point screw of FIG. 4 and hex-head screw of FIG. 5 may be fabricated from carbon steel having carbon contents as described above. The non-hardened screw portions may have an $R_C$ value of about 35 or less. The selectively hardened portions may have an $R_C$ value of at least about 45, preferably at least about 50, more preferably, at least about 55.

Figure 6:
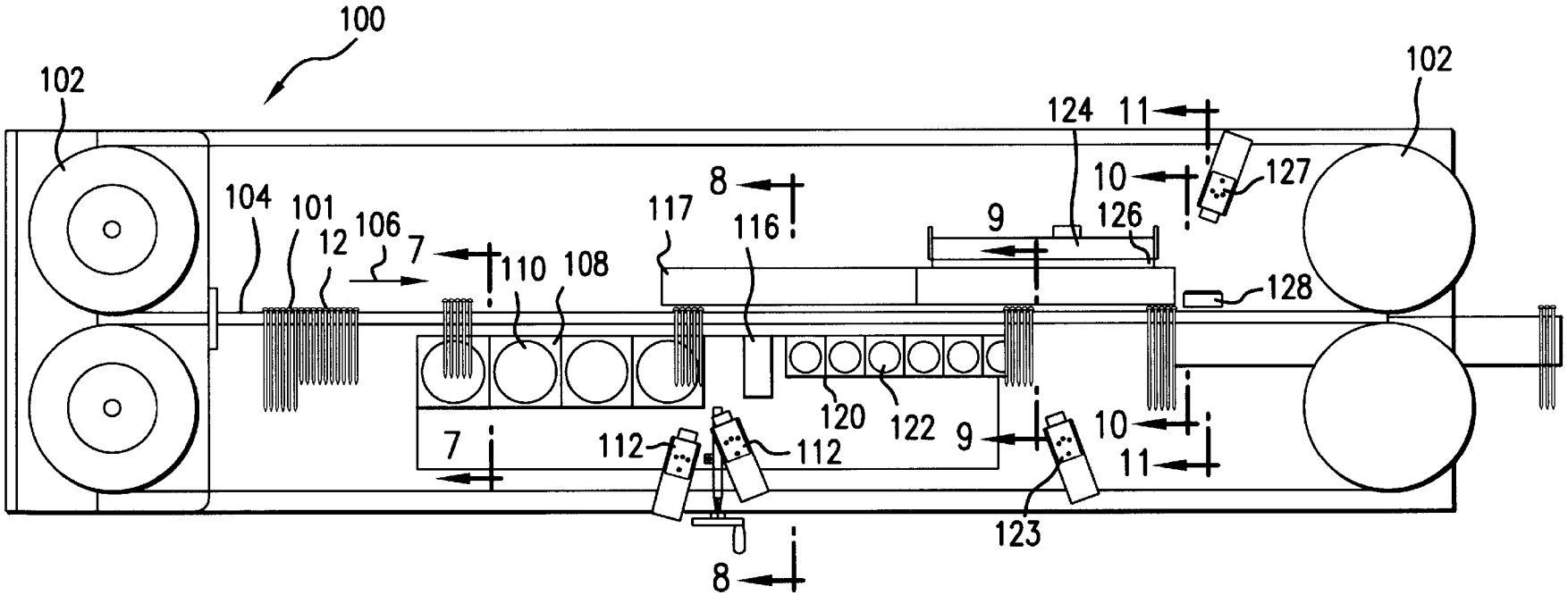
FIG. 6 is a schematic view of a heating apparatus for making selectively hardened screws.

The head and end regions of screws may be selectively hardened separately, using different processes, or may be treated in a single integrated process. FIGS. 6–11 schematically illustrate an apparatus 100 useful for heat treating selected portions of a large number of screws on a continuous basis. Referring to FIG. 6, apparatus 100 includes a transport mechanism 102 which cooperates with and moves a screw conveyor 104, which may be a link chain, in the direction of arrow 106. Screws 101, which can have a variety of lengths, are supported in the conveyor 104 below their respective head portions 12.

Figure 7:
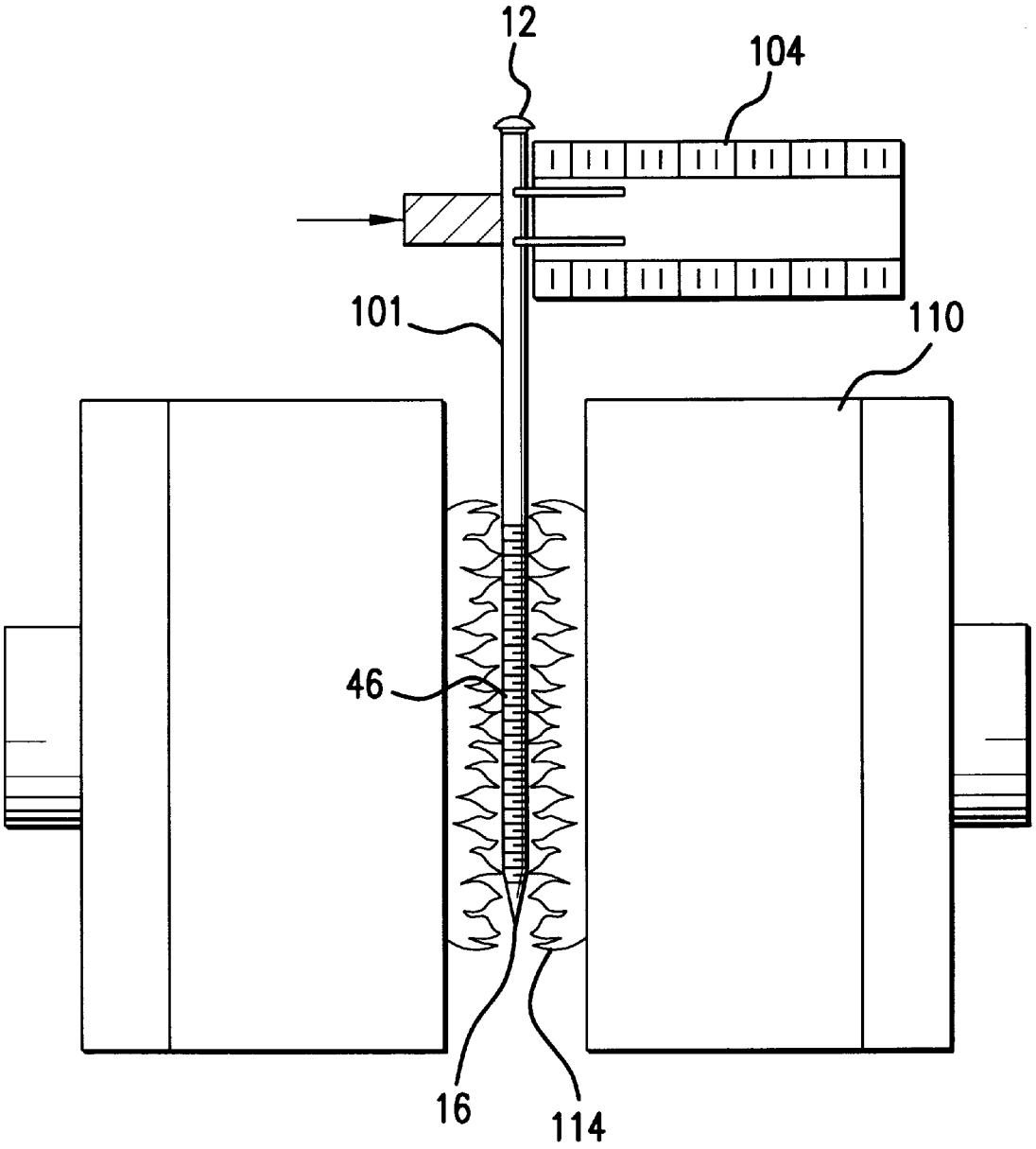
FIGS. 7–11 are sectional views taken along lines 7—7, 8—8, 9—9, 10—10, and 11—11 in FIG. 6.

Screws 101 arc carried on the conveyor 104 through a first heating assembly 108, which includes a plurality of flame burners 110 and thermocouples 112. As shown in FIG. 7, the flame burners 110 in assembly 108 are used to heat the lower end 46 and tip 16 of each screw 101, to a temperature most preferably between 1600–1800° F. The flame 114 is applied only to these selected screw portions. An exhaust hood 117 carries away excess heat.

Figure 8:
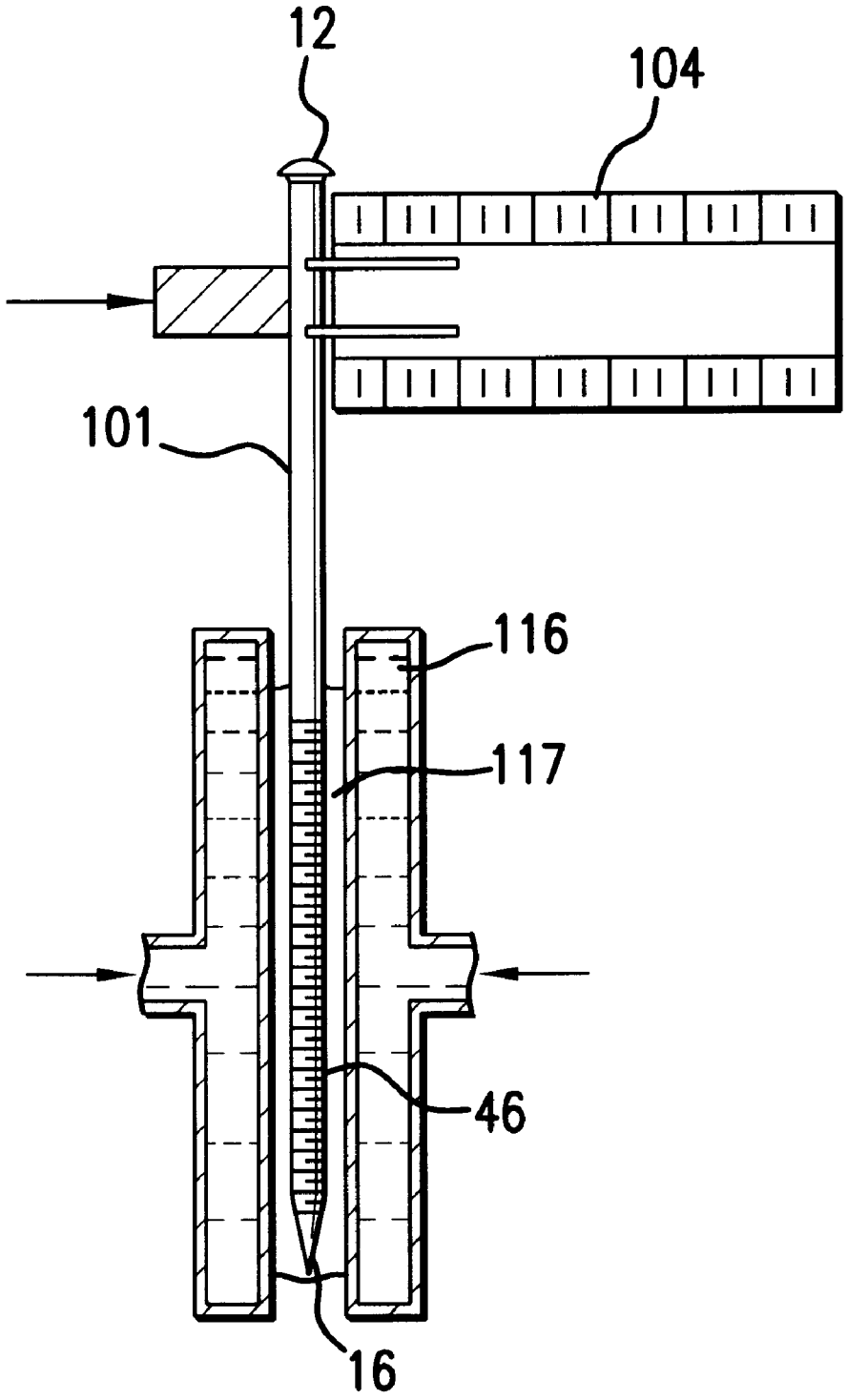

As the screws 101 are further conveyed beyond the first heating assembly 108, the lower end and tip of each screw 101 are then quenched using a cooling assembly 116. As illustrated in FIG. 8, the cooling assembly applies a water curtain 117, or process oil, or another cooling fluid selectively to the portions of each screw which have been heated. The heated portions are preferably cooled to 150° F. or less.

Figure 9:
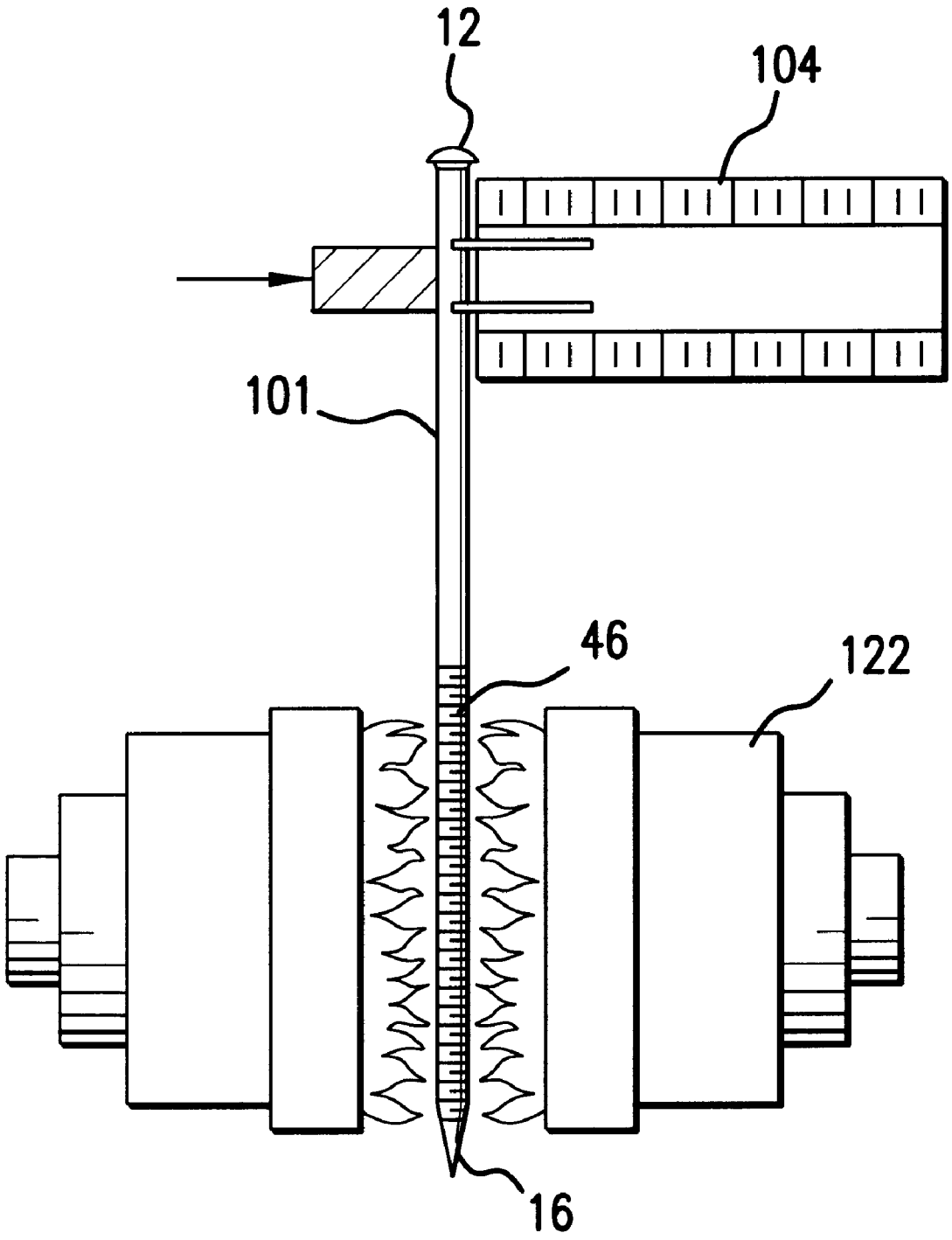

The first heating assembly, followed by cooling, may increase the Rockwell $R_C$ hardness of the lower end and tip of each screw, from a starting value less than 35 (and perhaps less than 25) to a value of about 45 or higher (and perhaps 50 or higher). It may be desirable to soften the threads in the lower end to an intermediate hardness, while maintaining the high hardness of the screw tip. This softening, called "tempering", can be accomplished by passing the hardened thread portion 46 of each screw through a second heating assembly 120. The second heating assembly 120 may include a plurality of smaller flame burners 122 which, as shown in FIG. 9, heat only the lower end 46 of each screw, but not the screw tip, to a temperature of about 750–1000° F. as determined by thermocouple sensor 123. This secondary heating step softens the lower portion 46 of each screw to an intermediate Rockwell $R_C$ value of about 35–45.

Figure 10:
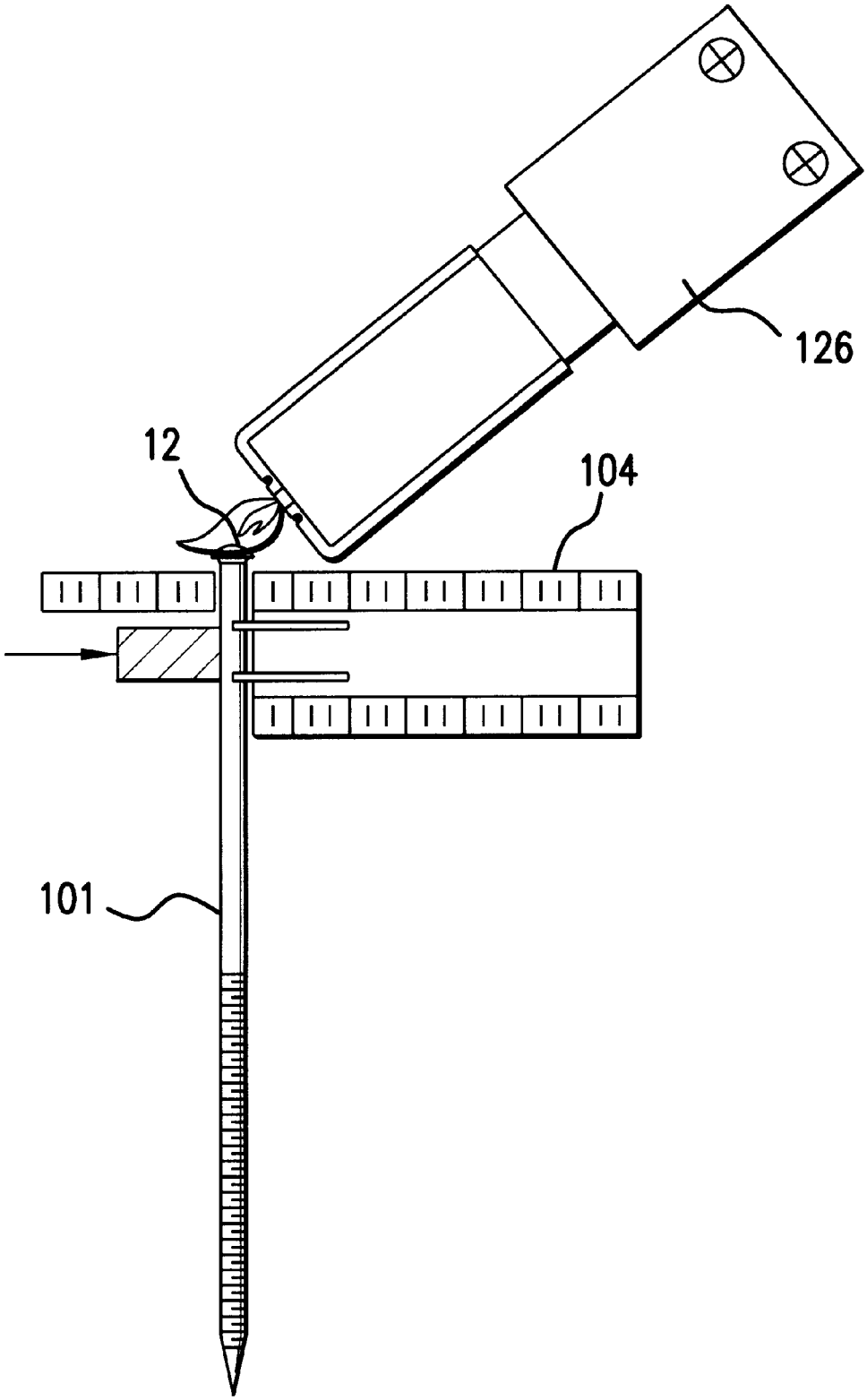
Figure 11:
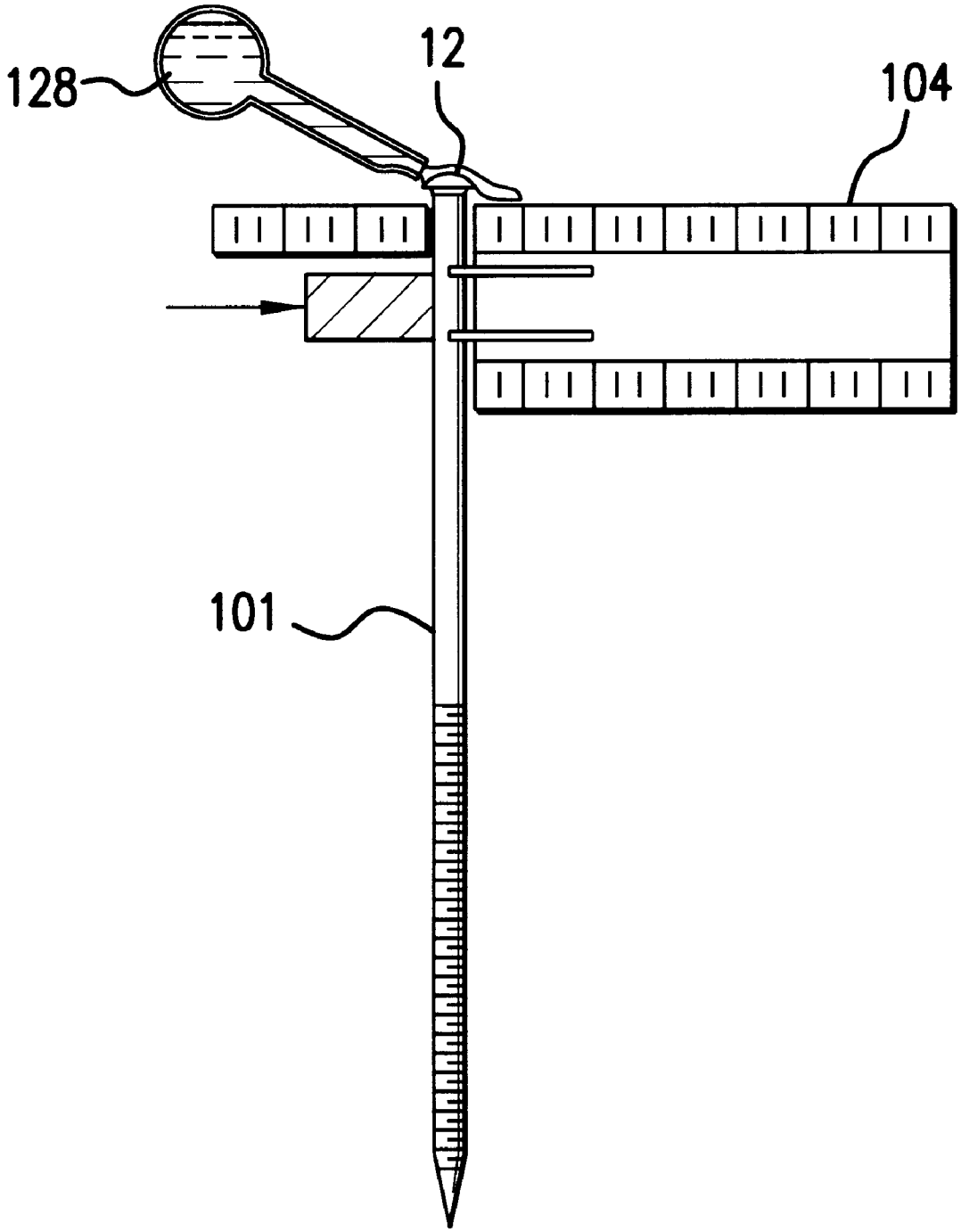

As the screws 101 are further conveyed, the head portions 12 are selectively heat treated using a third heating assembly 124 having one or more flame burners 126, and thermocouple 127. As shown in FIG. 10, the burners in the third heating assembly 124 aim the flame heat selectively toward the head portions 12. The head portions are most preferably heated to about 1600–1800° F. The head portions 12 are then selectively quenched using a cooling assembly 128 which, as shown in FIG. 11, directs water or another quenching fluid directly to the head portions 12. The head portions thus treated may have a Rockwell $R_C$ hardness value of about 45 or higher, perhaps about 50 or higher. The screws 101 may then exit the apparatus 100 for packaging or other use.

While the embodiments of the invention disclosed herein are presently considered preferred, various modifications and improvements can be made without departing from the spirit and scope of the invention. The scope of the invention is indicated by the appended claims, and all changes that fall within the meaning and range of equivalents are intended to be embraced therein.

We claim:

1. A selectively hardened carbon steel screw comprising a screw head, a shank having a first end adjacent the head and a second end, and a screw tip adjacent the second end of the shank;

the screw head including a top surface, a bottom, a center region, an outer rim and a recess in the center region for receiving a driving tool;

the screw head having a martensitic metallurgical structure on the top surface in the center region, and a ferritic perlitic metallurgical structure on the bottom.

2. The screw of claim 1, wherein the shank has a ferritic perlitic metallurgical structure.

3. The screw of claim 1, wherein the shank has a ferritie perlitic metallurgical structure at the first end and a martensitic metallurgical structure at the second end, and the screw tip has a martensitic metallurgical structure.

4. The screw of claim 1, comprising about 0.15–0.50% by weight carbon in the steel.

5. The screw of claim 1, comprising about 0.18–0.35% by weight carbon in the steel.

6. A selectively hardened carbon steel screw comprising a screw head, a shank having a first end adjacent the head and a second end, and a screw tip adjacent the second end of the shank;

the screw head including an upper selectively hardened portion and a lower portion which has not been hardened;

the shank including an upper portion which has not been hardened;

wherein the screw tip is also selectively hardened.

7. The screw of claim 6, wherein the shank further comprises a lower selectively hardened portion.

8. The screw of claim 6, wherein the selectively hardened screw tip has a Rockwell "C" hardness of at least about 45.

9. The screw of claim 8, wherein the Rockwell "C" hardness is at least about 50.

10. The screw of claim 7, wherein the selectively hardened portion of the shank has a Rockwell "C" hardness of about 35–45.

11. A selectively hardened carbon steel screw comprising a screw head, a screw shank having a first end adjacent the head and a second end, and a screw tip adjacent the second end of the shank;

wherein a portion or portions of the screw are selectively hardened by heat treatment to an elevated temperature of at least about 1400° F., followed by quenching, to yield a Rockwell "C" hardness at least about 10 units higher than a remaining portion or portions of the screw not selectively hardened.

12. The screw of claim 11, wherein an upper portion of the head is selectively hardened.

13. The screw of claim 12, wherein a lower portion of the head is not hardened.

14. The screw of claim 11, wherein the screw tip is selectively hardened.

15. The screw of claim 14, wherein the second end of the shank is first selectively hardened and then tempered.

16. The screw of claim 11, wherein the elevated temperature is about 1500–2000° F.

17. The screw of claim 11, wherein the elevated temperature is about 1600–1800° F.

18. The screw of claim 11, wherein the selectively hardened portion or portions are selectively quenched.

19. The screw of claim 11, wherein the head comprises a single slot having a hardened upper portion.

20. The screw of claim 11, wherein the head comprises two slots which cross each other, having hardened upper portions.

21. The screw of claim 11, wherein the head comprises a hex-head.

22. The screw of claim 21, wherein the hex-head comprises a hardened recessed area.

23. The screw of claim 21, wherein the hex-head comprises hardened outer surfaces.

24. The screw of claim 11, wherein the screw tip comprises a hardened drill tip.

25. The screw of claim 11, wherein the shank comprises case-hardened threads.

* * * * *